US011688949B2

(12) United States Patent
Takahashi

(10) Patent No.: US 11,688,949 B2
(45) Date of Patent: Jun. 27, 2023

(54) RADIO COMMUNICATION APPARATUS

(71) Applicant: NEC Corporation, Tokyo (JP)

(72) Inventor: Yoshihide Takahashi, Tokyo (JP)

(73) Assignee: NEC CORPORATION, Tokyo (JP)

( * ) Notice: Subject to any disclaimer, the term of this patent is extended or adjusted under 35 U.S.C. 154(b) by 188 days.

(21) Appl. No.: 17/417,483

(22) PCT Filed: Nov. 15, 2019

(86) PCT No.: PCT/JP2019/044897
§ 371 (c)(1),
(2) Date: Jun. 23, 2021

(87) PCT Pub. No.: WO2020/137240
PCT Pub. Date: Jul. 2, 2020

(65) Prior Publication Data

US 2021/0391652 A1 Dec. 16, 2021

(30) Foreign Application Priority Data

Dec. 26, 2018 (JP) ..... JP2018-243364

(51) Int. Cl.
*H01Q 13/18* (2006.01)
*H01Q 21/06* (2006.01)
(Continued)

(52) U.S. Cl.
CPC ..... *H01Q 13/18* (2013.01); *H01Q 13/106* (2013.01); *H01Q 21/005* (2013.01);
(Continued)

(58) Field of Classification Search
CPC ..... H01Q 13/18; H01Q 21/061; H01Q 23/00; H01Q 21/064; H01Q 21/0075;
(Continued)

(56) References Cited

U.S. PATENT DOCUMENTS 9,214,738 B2 * 12/2015 Yehezkely ..... H01Q 23/00
9,680,232 B2 * 6/2017 Markish ..... H01Q 21/067
(Continued)

FOREIGN PATENT DOCUMENTS

JP 2008047647 A 2/2008
JP 2014170989 A 9/2014
WO 2009128866 A1 10/2009

OTHER PUBLICATIONS

International Search Report for PCT Application No. PCT/JP2019/044897, dated Feb. 4, 2020.

*Primary Examiner* — Vibol Tan
(74) *Attorney, Agent, or Firm* — Sughrue Mion, PLLC

(57) ABSTRACT

A radio communication apparatus includes an RF circuit formed on one surface of a printed board and configured to generate an RF signal, a transmission line configured to transmit the RF signal, a transmission line configured to transmit a signal different from the RF signal, a ground layer formed on another surface of the printed board, an antenna element configured to emit the RF signal supplied from the RF circuit through the transmission line, and a connection layer configured to bond together the antenna element and the ground layer. The antenna element includes a plurality of layered dielectric substrates, a metal film formed on surfaces of them, and a through hole formed to penetrate the dielectric substrate closest to the printed board. A part of the transmission line is disposed between any of the plurality of layered dielectric substrates.

20 Claims, 10 Drawing Sheets

(51) Int. Cl.
*H01Q 21/00* (2006.01)
*H01Q 23/00* (2006.01)
*H01Q 13/10* (2006.01)

(52) U.S. Cl.
CPC ..... *H01Q 21/061* (2013.01); *H01Q 21/064* (2013.01); *H01Q 23/00* (2013.01)

(58) Field of Classification Search
CPC ..... H01Q 21/00; H01Q 21/0087; H05K 3/46; H05K 1/0298; H05K 1/0251; H05K 1/0243
See application file for complete search history.

(56) References Cited

U.S. PATENT DOCUMENTS

| | | | | |
|---|---|---|---|---|
| 11,189,899 | B2 * | 11/2021 | Takahashi | H01P 3/18 |
| 11,271,323 | B2 * | 3/2022 | Takahashi | H01Q 13/106 |
| 11,424,195 | B2 * | 8/2022 | Shaul | H01Q 1/2283 |
| 11,462,837 | B2 * | 10/2022 | Kuwabara | H01Q 21/065 |
| 2007/0069834 | A1 | 3/2007 | Ikuta et al. | |
| 2009/0256752 | A1 | 10/2009 | Akkermans et al. | |
| 2018/0159203 | A1 | 6/2018 | Baks et al. | |

* cited by examiner

RADIO COMMUNICATION APPARATUS

This application is a National Stage Entry of PCT/JP2019/044897 filed on Nov. 15, 2019, which claims priority from Japanese Patent Application 2018-243364 filed on Dec. 26, 2018, the contents of all of which are incorporated herein by reference, in their entirety.

TECHNICAL FIELD

The present disclosure relates to a radio communication apparatus and, for example, to a radio communication apparatus suitable for transmitting and receiving wideband RF (Radio Frequency) signals with reduced power loss.

BACKGROUND ART

A phased array antenna at least includes a plurality of phase shifters that adjusts the phase of a reference RF signal and generates a plurality of RF signals, a control circuit that controls the phase shift amount of each of the plurality of phase shifters, and a plurality of antenna elements that emit the phase-adjusted plurality of RF signals into the air.

A recent demand for a phased array antenna is that an RF circuit including a plurality of phase shifters and a control circuit for controlling their phase shift amounts and a plurality of antenna elements are integrally formed on one printed board. By integrally forming the RF circuit and the plurality of antenna elements on one printed board, a cable and a waveguide for connecting the RF circuit to the plurality of antenna elements are not needed, which allows a decrease in circuit size and power loss of a transmission path. Further, at an extremely high frequency such as in a millimeter waveband, the distance between adjacent antenna elements becomes smaller in proportion to wavelength, and therefore the level of difficulty in mounting is extremely high when an RF circuit and antennas are not integrally formed.

One way to integrally form an RF circuit and a plurality of antenna elements on one printed board is to form each of the plurality of antenna elements by using a planar antenna called a patch antenna as disclosed in Patent Literature 1, for example. However, use of the patch antenna results in a narrower bandwidth of an RF signal.

On the other hand, Patent Literature 2 discloses the configuration of a cavity slot antenna. The antenna having this configuration is able to transmit and receive an RF signal with a wider bandwidth compared with the case of using the patch antenna. However, in the configuration of the antenna disclosed in Patent Literature 2, the antenna is formed using a metallic material only, and how antennas and an RF circuit are integrally formed on a printed board is not disclosed. Therefore, it has not been made clear how to implement a phased array antenna by a cavity slot antenna.

CITATION LIST

Patent Literature

Patent Literature 1: United States Patent Publication No. 2018/0159203

Patent Literature 2: Japanese Unexamined Patent Application Publication No. 2014-170989

SUMMARY OF INVENTION

Technical Problem

As described above, in the antenna configuration of Patent Literature 1, while it is possible to integrally form an RF circuit and antennas, the bandwidth of an RF signal is narrow. On the other hand, in the antenna configuration of Patent Literature 2, while the bandwidth of an RF signal is wide, it is difficult to integrally form an RF circuit and antennas. Therefore, there has been a problem that a phased array antenna in which an RF circuit and antennas are integrally formed to reduce power loss and which is capable of transmitting and receiving wideband RF signals is not achievable in the antenna configurations of Patent Literatures 1 and 2.

An object of the present disclosure is to provide a radio communication apparatus that solves the above problem.

Solution to Problem

According to one example embodiment, a radio communication apparatus includes a printed board; an RF circuit formed on one surface of the printed board and configured to generate an RF signal; a first transmission line configured to transmit the RF signal; a second transmission line configured to transmit a different signal from the RF signal; a first ground layer formed on another surface of the printed board; an antenna configured to emit the RF signal supplied from the RF circuit through the first transmission line; and a connection layer configured to bond together the antenna and the first ground layer, wherein the antenna includes a plurality of layered dielectric substrates; a metal film formed on surfaces of the plurality of dielectric substrates; and a through hole formed to penetrate at least a dielectric substrate closest to the printed board among the plurality of dielectric substrates, the first ground layer, and the connection layer, the first transmission line is disposed from the RF circuit to an area facing the through hole on the one surface of the printed board, and a part of the second transmission line is disposed between any of the plurality of layered dielectric substrates.

According to another example embodiment, a radio communication apparatus includes a printed board; an RF circuit formed on one surface of the printed board and configured to generate a plurality of RF signals; a plurality of first transmission lines configured to transmit the plurality of RF signals; a plurality of second transmission lines configured to transmit a plurality of signals different from the plurality of RF signals; a first ground layer formed on another surface of the printed board; a plurality of antenna elements configured to emit the plurality of RF signals supplied from the RF circuit through the plurality of first transmission lines, respectively; and a connection layer configured to bond together the plurality of antenna elements and the first ground layer, wherein each of the plurality of antenna elements includes a plurality of layered dielectric substrates; a metal film formed on surfaces of the plurality of dielectric substrates; and a through hole formed to penetrate at least a dielectric substrate closest to the printed board among the plurality of dielectric substrates, the first ground layer, and the connection layer, each of the plurality of first transmission lines is disposed from the RF circuit to an area facing the through hole on the one surface of the printed board, and a part of each of the plurality of second transmission lines is disposed between any of the plurality of layered dielectric substrates.

Advantageous Effects of Invention

According to the above example aspects, it is possible to provide a radio communication apparatus capable of transmitting and receiving wideband RF signals with reduced power loss.

DESCRIPTION OF EMBODIMENTS

Hereinafter, example embodiments will be described with reference to the drawings. Since the drawings are simplified, the technical scope of the example embodiments should not be narrowly interpreted on the basis of the description of the drawings. The same elements are denoted by the same reference signs, and repeated descriptions are omitted.

The disclosure will be described by dividing it into a plurality of sections or example embodiments whenever circumstances require it for convenience in the following embodiments. However, unless otherwise particularly specified, these sections or embodiments are not irrelevant to one another. One section or example embodiment is related to modified example, applications, details, supplementary explanations, and the like of some or all of the other ones. When reference is made to the number of elements or the like (including the number of pieces, numerical values, quantity, range, etc.) in the following example embodiments, the number thereof is not limited to a specific number and may be greater than or less than or equal to the specific number unless otherwise particularly specified and definitely limited to the specific number in principle.

Further, in the following example embodiments, components (including operation steps, etc.) are not always essential unless otherwise particularly specified and considered to be definitely essential in principle. Similarly, when reference is made to the shapes, positional relations, or the like of the components or the like in the following example embodiments, they will include ones, for example, substantially approximate or similar in their shapes or the like unless otherwise particularly specified and considered not to be definitely so in principle. This is similarly applied even to the above-described number or the like (including the number of pieces, numerical values, quantity, range, etc.).

First Example Embodiment

Figure 1:
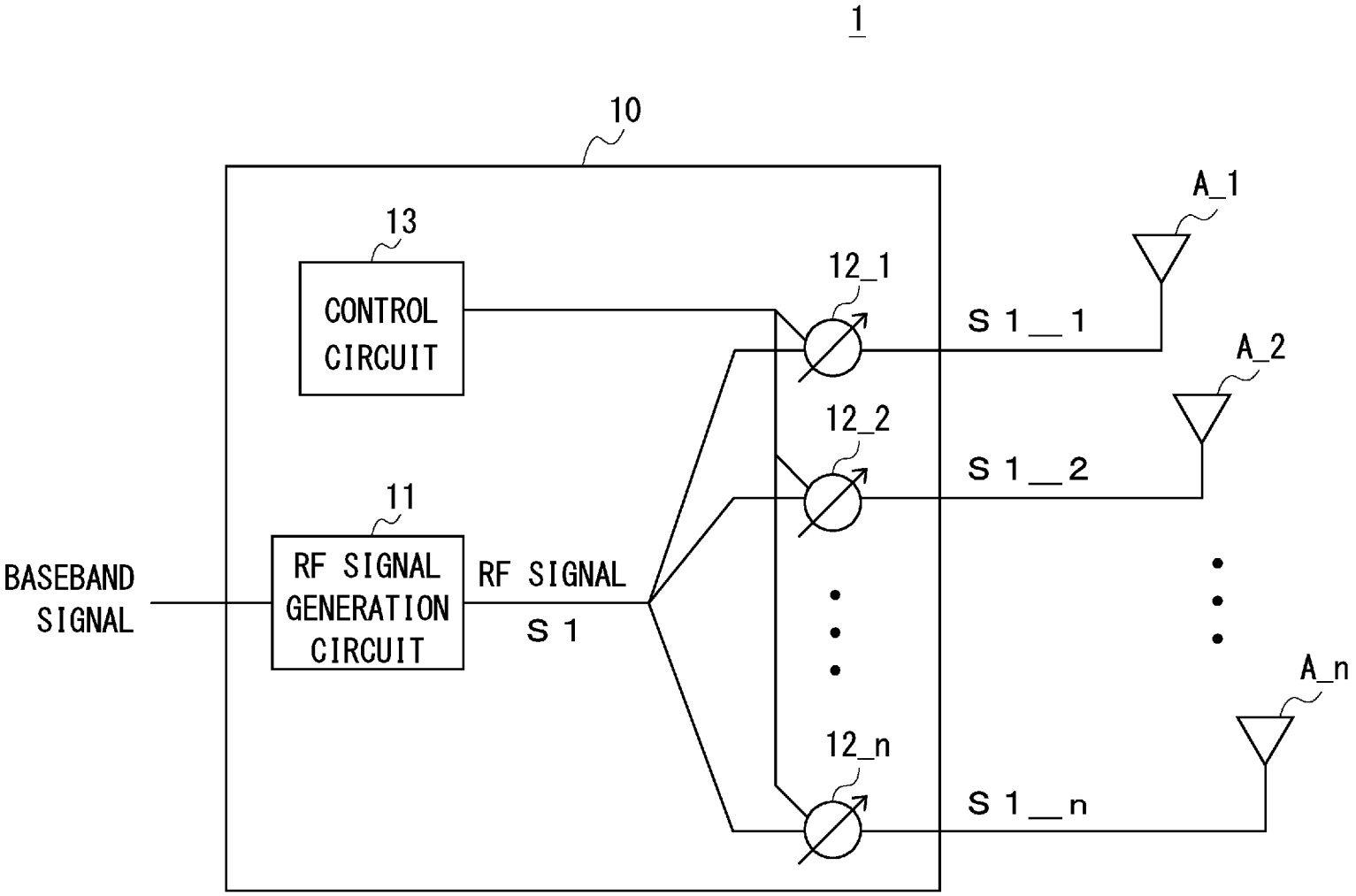
FIG. 1 is a block diagram showing a configuration example of a radio communication apparatus according to a first example embodiment.

FIG. 1 is a block diagram showing a configuration example of a radio communication apparatus 1 according to a first example embodiment.

As shown in FIG. 1, a radio communication apparatus 1 includes at least an RF circuit 10 and a plurality of antenna elements A_1 to A_n (n is an integer greater than or equal to 2) that constitutes an antenna. The RF circuit 10 includes at least an RF signal generation circuit 11, a plurality of phase shifters 12_1 to **12_*n*, and a control circuit 13**.

The RF signal generation circuit 11 modulates a baseband signal or an intermediate signal thereof (IF signal) into a high frequency RF signal S1 using a local signal (LO signal) from a local oscillator. The plurality of phase shifters 12_1 to **12_*n* adjust the phase of the RF signal S1 generated by the RF signal generation circuit 11 and output a plurality of RF signals S1_1 to S1_*n*, respectively. The control circuit 13 controls the respective phase shift amounts of the plurality of phase shifters 12_1 to 12_*n*. The plurality of RF signals S1_1 to S1_*n* are emitted into the air from antenna elements A_1 to A_n, respectively. By controlling the phases of the plurality of RF signals S1_1 to S1_*n*, the radio communication apparatus 1 can provide the RF signal S1** with directivity.

The RF signals S1_1 to S**1_*n* transmitted and received through the antenna elements A_1 to A_n are millimeter waves of a specific band in a range of, for example, 26 GHz to 110 GHz. Specifically, the RF signals S1_1 to S1_*n* are millimeter waves in a band from 60 GHz to 90 GHz (E band). Alternatively, the RF signals S1_1 to S1_*n* are any of millimeter waves in the band from 26 GHz to 40 GHz (Ka band), millimeter waves in the band from 50 GHz to 70 GHz (V band), and millimeter waves in the band from 75 GHz to 110 GHz (W band). When the RF signals S1_1 to S1_*n* of such a high frequency band are transmitted and received, it is particularly important to reduce the power loss of the RF signals S1_1 to S1_*n* in the transmission lines from the RF circuit 10 to the plurality of antenna elements A_1** to A_n.

(Preliminary Study by the Inventor)

First, radio communication apparatuses 51 and 61 which have been studied in advance by the present inventor will be described before explaining a configuration of the radio communication apparatus 1 described above.

(Cross-Sectional Structure of Radio Communication Apparatus 51)

Figure 9:
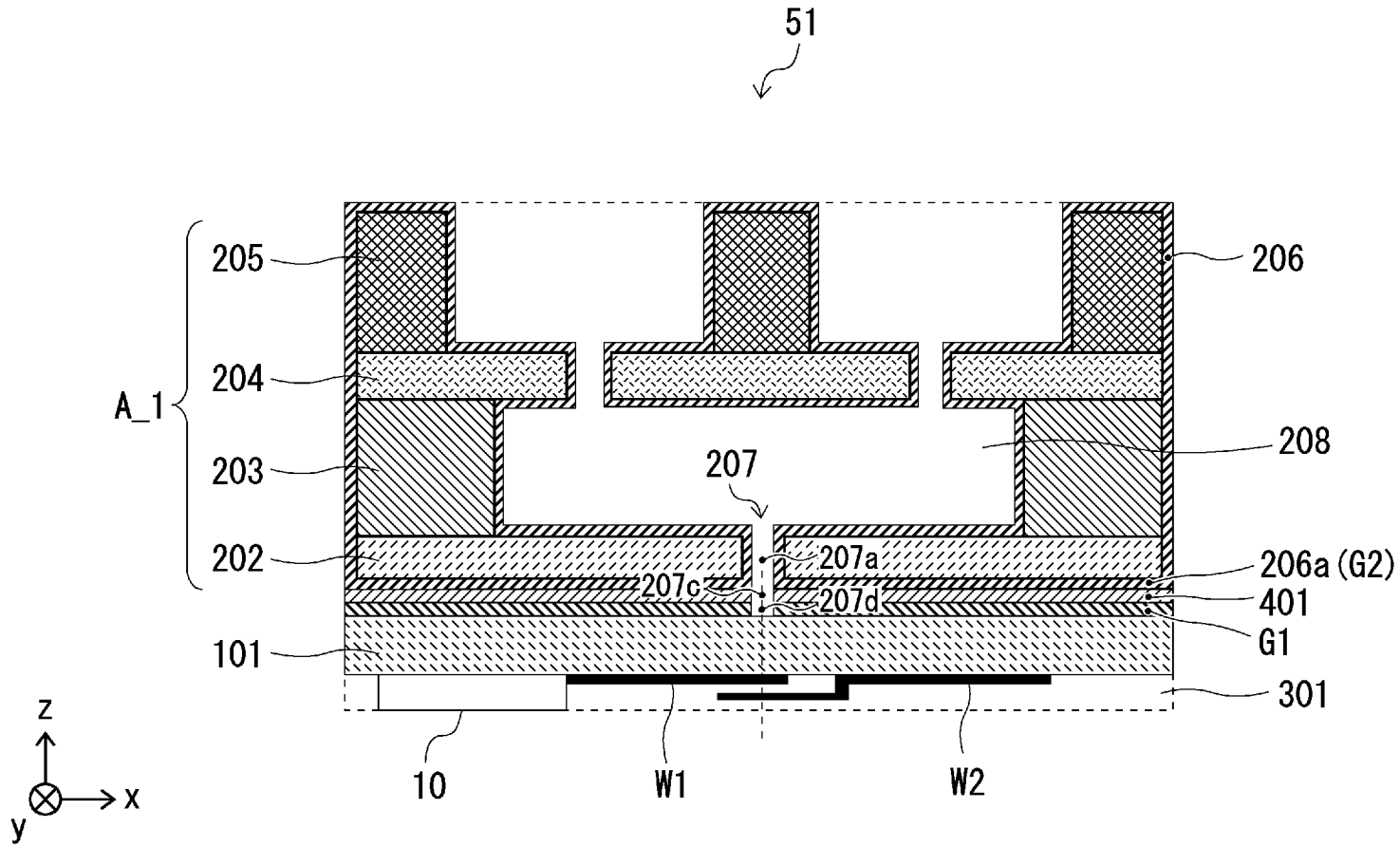
FIG. 9 is a schematic cross-sectional view of a radio communication apparatus according to a concept before conceiving the first example embodiment.

FIG. 9 is a schematic cross-sectional view of a radio communication apparatus 51 according to a concept before conceiving the first example embodiment.

As shown in FIG. 9, the radio communication apparatus 51 includes at least a printed board 101, an RF circuit 10, a transmission line W1, a transmission line W2, a ground layer G1, a connection layer 401, and antenna elements A_1 to A_n constituting an antenna. In the example of FIG. 9, only the antenna element A_1 is shown as a representative of the plurality of antenna elements A_1 to A_n.

In the radio communication apparatus 51, the RF circuit 10 and the antenna elements A_1 to A_n are integrally formed on one printed board 101. Then, in the radio communication apparatus 51, it becomes unnecessary to connect the RF circuit 10 to the antenna elements A_1 to A_n by a cable or a waveguide, so that the circuit size can be reduced, and the power loss in the transmission line can also be reduced. This is specifically described below.

On one main surface of the printed board 101, an RF circuit formation layer 301 such as a PPE (Polyphenylene Ether) board, for example, is formed. In this RF circuit formation layer 301, the RF circuit 10 such as an MMIC (Monolithic Microwave Integrated Circuit) is formed. Further, in the RF circuit formation layer 301, the transmission line W1 for transmitting the RF signal S1_1 is wired. The transmission line W1 is wired in the RF circuit formation layer 301 from the RF circuit 10 to an area facing a through hole 207 of the antenna element A_1. In other words, the transmission line W1 is wired in the RF circuit formation layer 301 from the RF circuit 10 to an area having the through hole 207 of the antenna element A_1 when the printed board 101 is viewed in the z-axis direction. Further, the transmission line W2 for transmitting signals other than the RF signal S1_1, such as an LO signal, an IF signal, and a power supply voltage, is wired in the RF circuit formation layer 301.

On the other main surface of the printed board 101, the ground layer G1 is formed. A ground voltage terminal of the RF circuit 10, for example, is connected to the ground layer G1 through a via, which is not shown, for example.

The antenna element A_1 composed of a plurality of dielectric substrates 202 to 205 and a metal film 206 is formed on the side of the other main surface of the printed board 101 with the connection layer 401, which is described later, interposed therebetween.

More specifically, the plurality of dielectric substrates 202 to 205 are layered in the formation layer of the antenna element A_1. The plurality of dielectric substrates 202 to 205 may be glass substrates for general use, for example, or substrates made of the same material as that of the printed board 101.

Among the layered dielectric substrates 202 to 205, a through hole 207*a* serving as a waveguide is formed in the dielectric substrate 202 disposed closest to the printed board 101. In the dielectric substrates 203 to 205, a space area 208 continuous to the through hole 207*a* is formed. Further, the metal film 206 is formed by performing a plating treatment on the surfaces of the plurality of layered dielectric substrates 202 to 205. In the metal film 206, a metal film 206*a* formed on a surface in contact with the connection layer 401 forms a ground layer (hereinafter also referred to as a ground layer G2) of the antenna element A_1.

The connection layer 401 is formed using a conductive bonding film, for example, and bonds together the ground layer G1 of the RF circuit 10 and the ground layer G2 of the antenna element A_1. The ground layer G1 of the RF circuit 10 and the ground layer G2 of the antenna element A_1 are electrically connected through the conductive connection layer 401.

The connection layer 401 and the ground layer G1 have through holes 207*c* and 207*d*, respectively, that are continuous to the through hole 207*a* in the dielectric substrate 202 of the antenna element A_1. The through holes 207*a*, 207*c* and 207*d* form the through hole 207 of the antenna element A_1. Since the connection layer 401 is formed using a conductive bonding film, leakage of radio waves from the through hole 207 to the outside through the connection layer 401 is prevented.

The RF signal S1_1 generated by the RF circuit 10 is supplied to the antenna element A_1 through the transmission line W1. This RF signal S1_1 propagates through the through hole 207 serving as a waveguide and reaches the space area 208 of the antenna element A_1, and then is emitted into the air.

The antennas A_2 to A_n (not shown) have the same cross-sectional structure as that of the antenna element A_1, and thus the descriptions of the antennas A_2 to A_n will be omitted.

The antenna having the cross-sectional structure shown in FIG. 9 can transmit (or receive) an RF signal with a wider bandwidth compared with the case of using the patch antenna. Further, in the antenna having the cross-sectional structure shown in FIG. 9, unlike the patch antenna, no surface wave mode is generated, and thus the influence of mutual coupling can be reduced.

However, in the structure of the radio communication apparatus 51 shown in FIG. 9, only one layer of the RF circuit formation layer 301 is present, and thus it is necessary to use a special wiring structure when the transmission lines are wired in an intersecting manner. Consequently, there is a problem that the level of difficulty in manufacturing is increased, and the manufacturing cost is increased.

Therefore, the present inventor has studied a radio communication apparatus 61.

(Cross-Sectional Structure of Radio Communication Apparatus 61)

Figure 10:
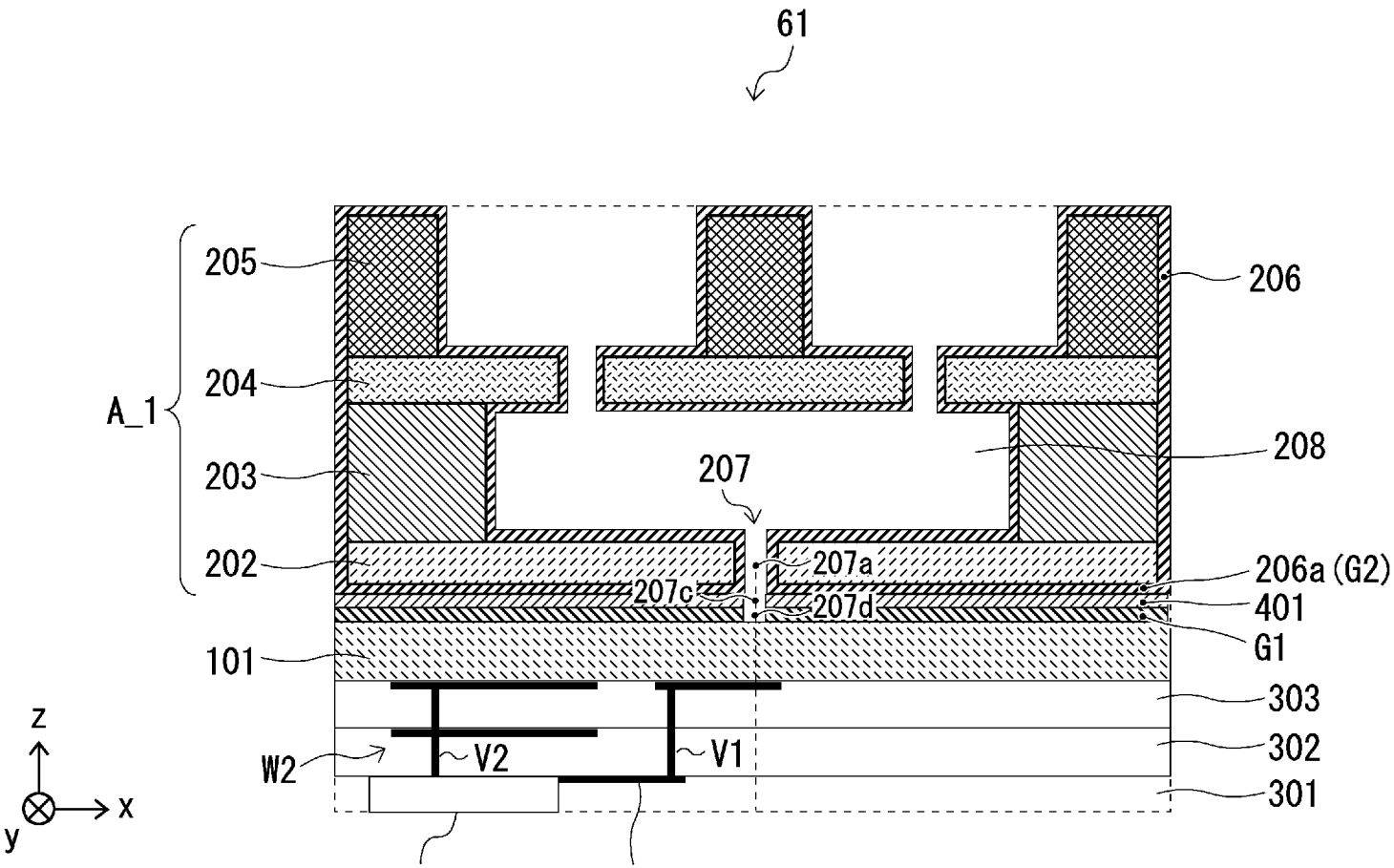
FIG. 10 is a schematic cross-sectional view of a radio communication apparatus according to a concept before conceiving the first example embodiment.

FIG. 10 is a schematic cross-sectional view of a radio communication apparatus 61 according to a concept before conceiving the first example embodiment.

As shown in FIG. 10, the radio communication apparatus 61 includes a plurality of RF circuit formation layers compared with the case of the radio communication apparatus 51.

Specifically, the RF circuit formation layers 301 to 303 are provided on one main surface of the printed board 101. The RF circuit 10 is formed in the RF circuit formation layer 301. In the RF circuit formation layers 302 and 303, a part of the transmission line W1 for transmitting the RF signal S1_1 is wired through a via V1, and a part of the transmission line W2 for transmitting signals other than the RF signal S1_1, such as an LO signal, an IF signal, and a power supply voltage, is wired through a via V2.

In the structure of the radio communication apparatus 61 shown in FIG. 10, it is not necessary to use a special wiring structure to wire the transmission lines in an intersecting manner, so that the level of difficulty in manufacturing is reduced, and the manufacturing cost is reduced.

However, in the structure of the radio communication apparatus 61 shown in FIG. 10, the via V1 is included in a part of the transmission line W1 wired from the RF circuit 10 to the area facing the through hole 207 of the antenna element A_1. This increases the power loss of the RF signal S1_1 in the transmission line W1. Thus, there has been a problem that the radio communication apparatus 61 cannot transmit (or receive) the wideband RF signal S1_1 with reduced power loss. For the same reason, there has been a problem that the radio communication apparatus 61 cannot transmit (or receive) wideband RF signals S1_2 to S1_*n* with reduced power loss. In particular, when the RF signals S1_1 to S1_*n* are millimeter waves in a high frequency band, the influence of the power loss due to the via V1 cannot be ignored.

Furthermore, in the structure of the radio communication apparatus 61 shown in FIG. 10, the thickness of a dielectric between the ground layer G1 and the formation layer 301 of the RF circuit 10 increases due to an increase in the number of layers of the RF circuit formation layer, thereby increasing the level of difficulty in designing.

In order to address such an issue, the present inventor has found the radio communication apparatus 1 according to the first example embodiment that can transmit (or receive) a wideband RF signal with reduced power loss without increasing the number of layers of an RF circuit formation layer by forming a transmission line using a metal film between a plurality of dielectric substrates constituting an antenna.

(Cross-Sectional Structure of Radio Communication Apparatus 1 According to the First Example Embodiment)

Figure 2:
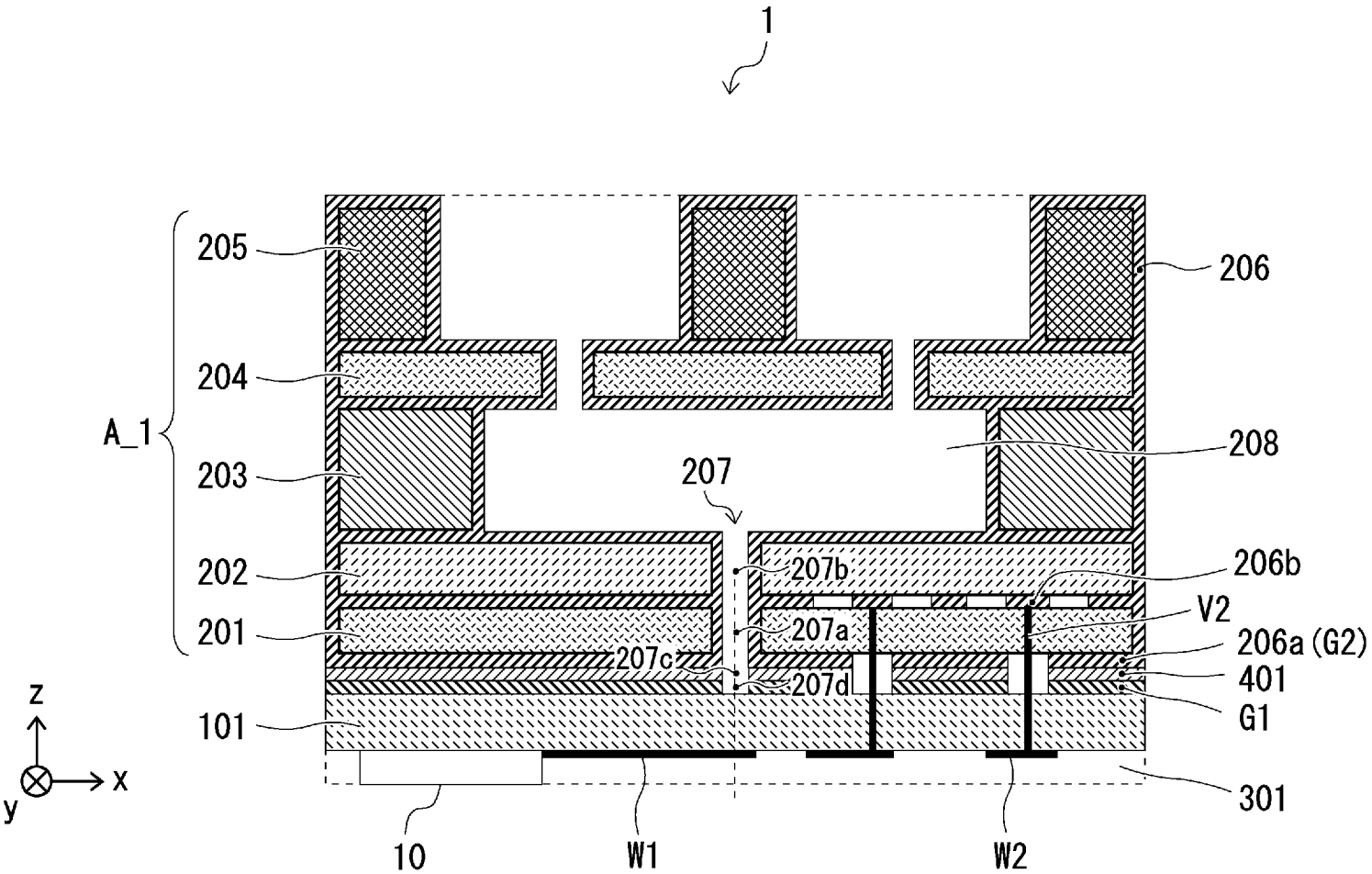
FIG. 2 is a schematic cross-sectional view of the radio communication apparatus according to the first example embodiment.

FIG. 2 is a schematic cross-sectional view of the radio communication apparatus 1 according to the first example embodiment.

As shown in FIG. 2, the radio communication apparatus 1 includes at least the printed board 101, the RF circuit 10, the transmission line W1, the transmission line W2, the ground layer G1, the connection layer 401, and the antenna elements A_1 to A_n constituting the antenna. In the example of FIG. 2, only the antenna element A_1 is shown as a representative of the plurality of antenna elements A_1 to A_n.

In the radio communication apparatus 1, the RF circuit 10 and the antenna elements A_1 to A_n are integrally formed on one printed board 101. Then, in the radio communication apparatus 1, it becomes unnecessary to connect the RF circuit 10 to the antenna elements A_1 to A_n by a cable or a waveguide, so that the circuit size can be reduced, and the power loss in the transmission line can also be reduced. This is specifically described below.

On one main surface of the printed board 101, an RF circuit formation layer 301 such as a PPE board, for example, is formed. In this RF circuit formation layer 301, the RF circuit 10 such as an MMIC is formed. Further, in the RF circuit formation layer 301, the transmission line W1 for transmitting the RF signal S1_1 is wired. The transmission line W1 is wired in the RF circuit formation layer 301 from the RF circuit 10 to an area facing the through hole 207 of the antenna element A_1. In other words, the transmission line W1 is wired in the RF circuit formation layer 301 from the RF circuit 10 to an area having the through hole 207 of the antenna element A_1 when the printed board 101 is viewed in the z-axis direction. Further, the transmission line W2 for transmitting signals other than the RF signal S1_1, such as an LO signal, an IF signal, and a power supply voltage, is wired in the RF circuit formation layer 301.

On the other main surface of the printed board 101, the ground layer G1 is formed. A ground voltage terminal of the RF circuit 10, for example, is connected to the ground layer G1 through a via, which is not shown, for example.

The antenna element A_1 composed of a plurality of dielectric substrates 201 to 205 and a metal film 206 is formed on the side of the other main surface of the printed board 101 with the connection layer 401, which is described later, interposed therebetween.

More specifically, the plurality of dielectric substrates 201 to 205 are layered in the formation layer of the antenna element A_1. The plurality of dielectric substrates 201 to 205 may be glass substrates for general use, for example, or substrates made of the same material as that of the printed board 101.

Among the layered dielectric substrates 201 to 205, through holes 207*a* and 207*b* serving as a waveguide are formed continuously in the dielectric substrate 201 disposed closest to the printed board 101 and the dielectric substrate 202 adjacent thereto. In the dielectric substrates 203 to 205, a space area 208 continuous to the through holes 207*a* and 207*b* is formed. Further, the metal film 206 such as a copper thin film is formed by performing a plating treatment on the surfaces of the plurality of layered dielectric substrates 201 to 205. In the metal film 206, a metal film 206*a* formed on a surface in contact with the connection layer 401 forms a ground layer (hereinafter also referred to as a ground layer G2) of the antenna element A_1. As described earlier, in the metal film 206, the metal film 206*a* formed on a surface in contact with the connection layer 401 forms a ground layer (hereinafter also referred to as the ground layer G2) of the antenna element A_1.

The connection layer 401 is formed using a conductive bonding film, for example, and bonds together the ground layer G1 of the RF circuit 10 and the ground layer G2 of the antenna element A_1. The ground layer G1 of the RF circuit 10 and the ground layer G2 of the antenna element A_1 are electrically connected through the conductive connection layer 401.

The connection layer 401 and the ground layer G1 have through holes 207*c* and 207*d*, respectively, that are continuous to the through holes 207*a* and 207*b* respectively in the dielectric substrates 201 and 202 of the antenna element A_1. The through holes 207*a*, 207*b*, 207*c* and 207*d* form the through hole 207 of the antenna element A_1. Since the connection layer 401 is formed using a conductive bonding film, leakage of radio waves from the connection layer 401 to the outside is prevented.

The RF signal S1_1 generated by the RF circuit 10 is supplied to the antenna element A_1 through the transmission line W1. The RF signal S1_1 propagates through the through hole 207 serving as a waveguide and reaches the space area 208 of the antenna element A_1, and then is emitted into the air.

The antennas A_2 to A_n (not shown) have the same cross-sectional structure as that of the antenna element A_1, and thus the descriptions of the antennas A_2 to A_n will be omitted.

Figure 3:
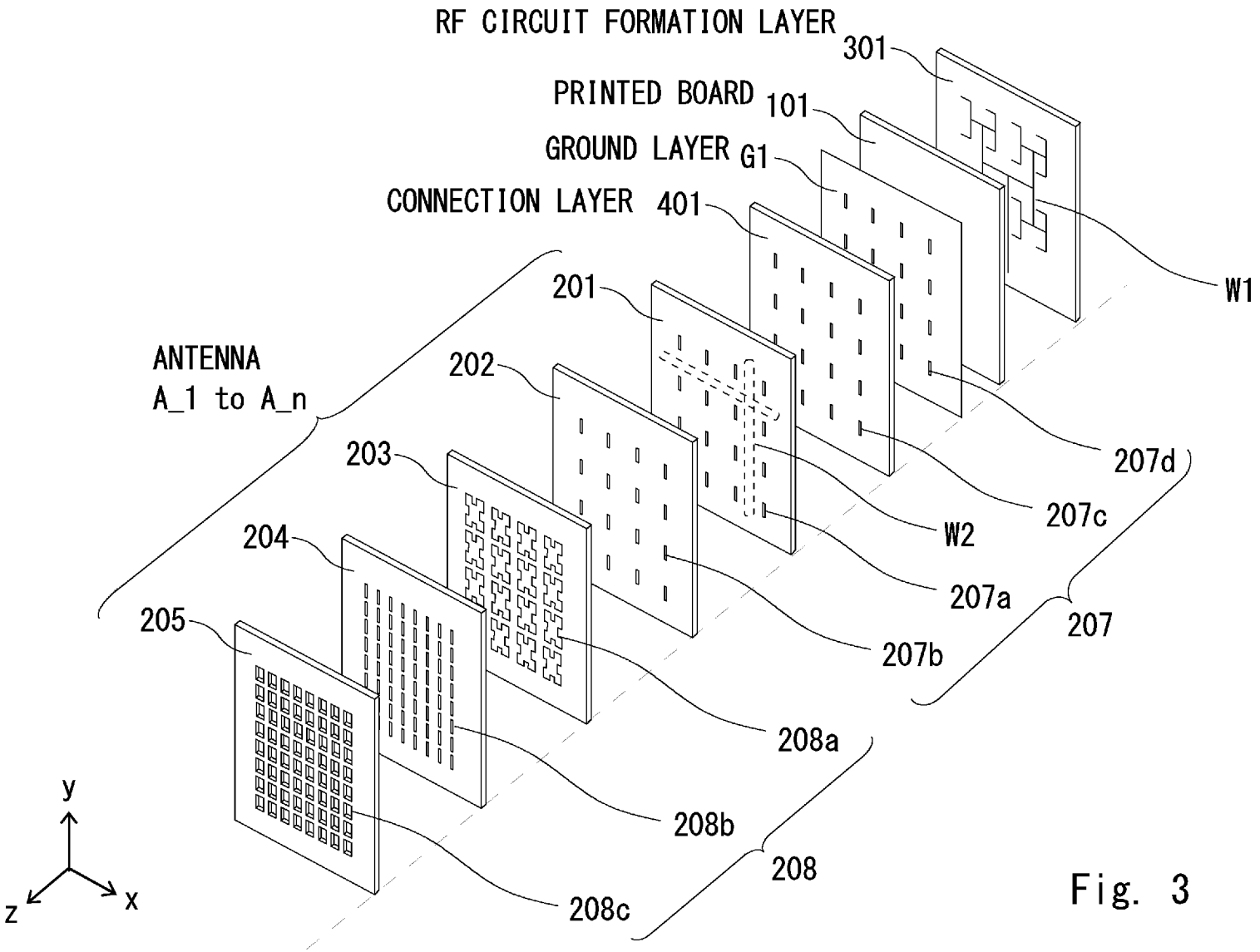
FIG. 3 is a diagram for explaining each layer of the radio communication apparatus shown in FIG. 2.

FIG. 3 is a diagram showing the radio communication apparatus 1 shown in FIG. 2 divided into layers.

As shown in FIG. 3, slit patterns (207*a*) of the plurality of through holes 207*a* are formed in the dielectric substrates 201, and slit patterns (207*b*) of the plurality of through holes 207*b* are formed in the dielectric substrates 202. Slit patterns (207*c*) of the plurality of through holes 207*c* are formed in the connection layer 401, and slit patterns (207*d*) of the plurality of through holes 207*d* are formed in the ground layer G1 of the RF circuit 10. Further, slit patterns 208*a*, 208*b*, and 208*c* of the plurality of space areas 208 are formed in the dielectric substrate 203 to 205, respectively.

Further, the metal film 206 is formed (not shown in FIG. 3) on each of the surfaces of the dielectric substrates 201 to 205. To be more specific, the metal film 206 is formed on each of the surfaces of the dielectric substrates 201 to 205 by performing a plating treatment on each of the surfaces of the dielectric substrates 201 to 205 before the dielectric substrates 201 to 205 are layered. As described earlier, in the metal film 206, the metal film 206*a* formed on the surface (the main surface of the dielectric substrate 201 on the side of the printed board 101) in contact with the connection layer 401 forms the ground layer G2 of the antenna elements A_1 to A_n.

Here, the transmission line W1 for transmitting the RF signal S1_1 is wired in the RF circuit formation layer 301. On the other hand, the transmission line W2 for transmitting signals other than the RF signal S1_1, such as an LO signal, an IF signal, and a power supply voltage, is not only wired in the RF circuit formation layer 301 but also wired using the metal film 206 (hereinafter referred to as the metal film 206*b*) formed between the dielectric substrates 201 and 202. Note that the transmission line W2 wired between the dielectric substrates 201 and 202 is formed by performing a plating treatment while the dielectric substrate is masked with the mask pattern of the transmission line W2 when the metal film 206*a* is formed between the dielectric substrates 201 and 202. For example, signals other than the RF signal S1_1 such as an LO signal, an IF signal, and a power supply voltage are transmitted from the transmission line W2 formed in the RF circuit formation layer 301 to the transmission line W2 formed by the metal film 206*b* between the dielectric substrates 201 and 202 through the via V2. The same applies to the relationship between the RF signals S1_2 to S1_*n* and signals other than the RF signals S1_2 to S1_*n*.

Thus, in the radio communication apparatus 1, the transmission lines W1 and W2 can be wired without increasing the number of layers of the RF circuit formation layer 301. As a result, the transmission line W1 can be wired from the RF circuit 10 to right under the through hole 207 of the antenna element A_1 without using the via V1, and therefore the power loss of the RF signal S1_1 is suppressed. The same applies to the RF signals S1_2 to S1_*n*.

In the radio communication apparatus 1, since it is not necessary to use a special wiring structure for wiring in an intersecting manner, the level of difficulty in designing is reduced, and the manufacturing cost is reduced.

As described above, in the radio communication apparatus 1 according to this example embodiment, the transmission line W2 other than the transmission line W1 for transmitting RF signals is formed between the plurality of dielectric substrates, which are components of the antenna, using the metal film provided between the plurality of dielectric substrates. By doing so, in the radio communication apparatus 1 according to this example embodiment, it is not necessary to increase the number of layers of the RF circuit formation layer, so that the transmission line W1 for transmitting the RF signal can be wired without using a via. As a result, the power loss of the RF signals is suppressed.

Figure 4:
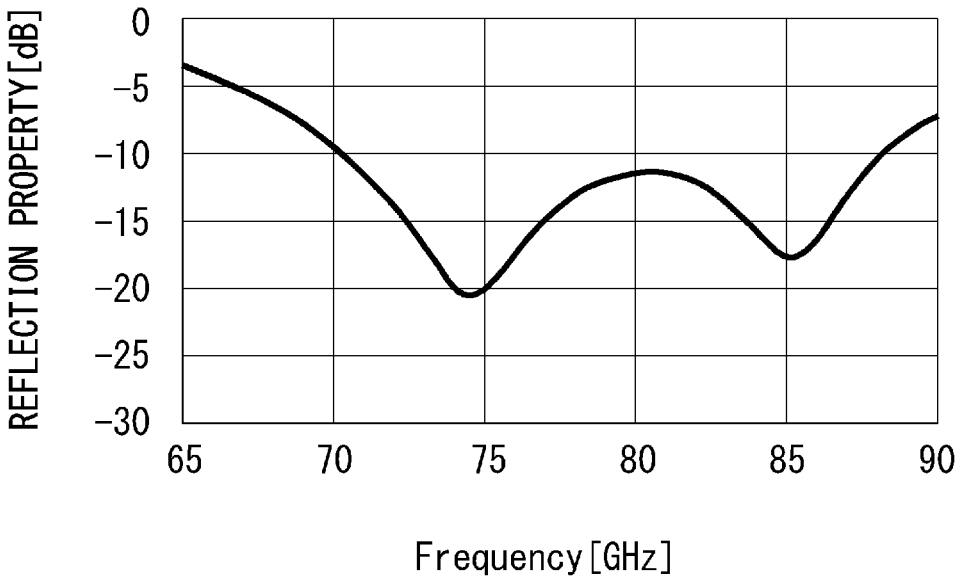
FIG. 4 is a diagram showing an example of the characteristics of an antenna with a wider bandwidth.

Further, in the radio communication apparatus 1 according to this example embodiment, by using an antenna made up of a plurality of layered dielectric substrates, it is capable of transmitting (or receiving) an RF signal with a wider bandwidth compared with the case of using the patch antenna (see FIG. 4). Therefore, the radio communication apparatus 1 according to the first example embodiment is capable of transmitting (or receiving) wideband RF signals with reduced power loss.

In this example embodiment, the case where all of the layered dielectric substrates 201 to 205 are any of a substrate made of glass and a substrate made of the same material as the printed board 101 has been described as an example; however, the present disclosure is not limited to this case. For example, any of the dielectric substrates 201 to 205 may be made of a metallic material. This is specifically described hereinafter with reference to FIG. 5.

[Modified Example of Radio Communication Apparatus 1]

Figure 5:
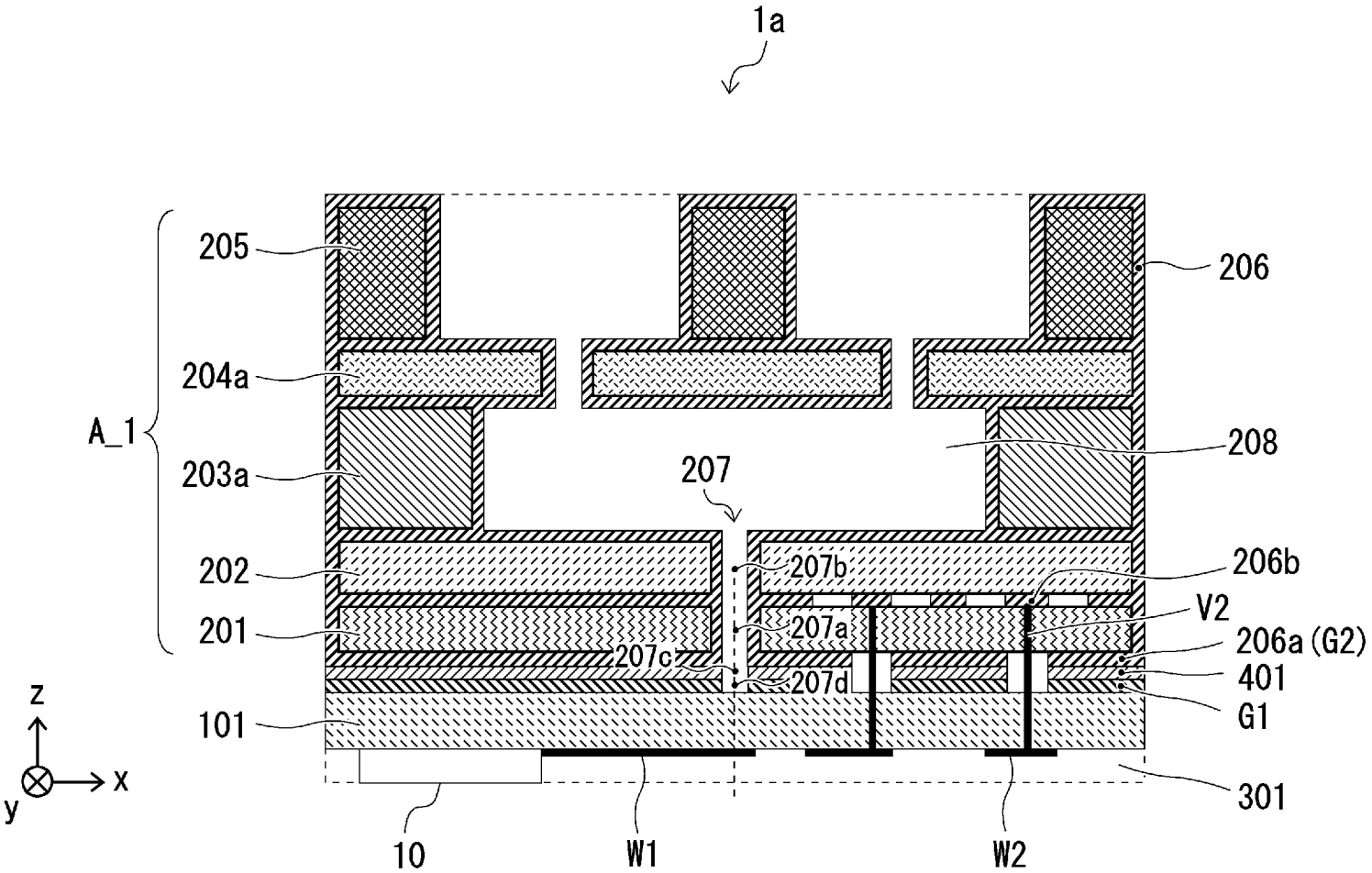
FIG. 5 is a schematic cross-sectional view showing a modified example of the radio communication apparatus according to the first example embodiment.

FIG. 5 is a schematic cross-sectional view showing a modified example of the radio communication apparatus 1 as a radio communication apparatus 1*a*.

In the radio communication apparatus 1*a*, compared with the radio communication apparatus 1, metallic materials 203*a* and 204*a* are used instead of the dielectric substrates 203 and 204, which are any of a substrate made of glass and a substrate made of the same material as the printed board 101. The metallic dielectric substrate and another dielectric substrate are layered with a nonconductive material such as prepreg, for example, interposed therebetween. The other configuration of the radio communication apparatus 1*a* is the same as that of the radio communication apparatus 1, and thus the descriptions thereof will be omitted.

As described above, in the radio communication apparatus 1*a*, any of the plurality of dielectric substrates constituting the antenna is made of a metallic material. The metallic material can be easily processed into a desired shape.

Although the case where the dielectric substrates 203 and 204, among the plurality of dielectric substrates 201 to 205, are made of metallic materials is described in this example embodiment, the present disclosure is not limited to this case, and an arbitrary dielectric substrate of the plurality of dielectric substrates 201 to 205 may be made of a metallic material.

Second Example Embodiment

Figure 6:
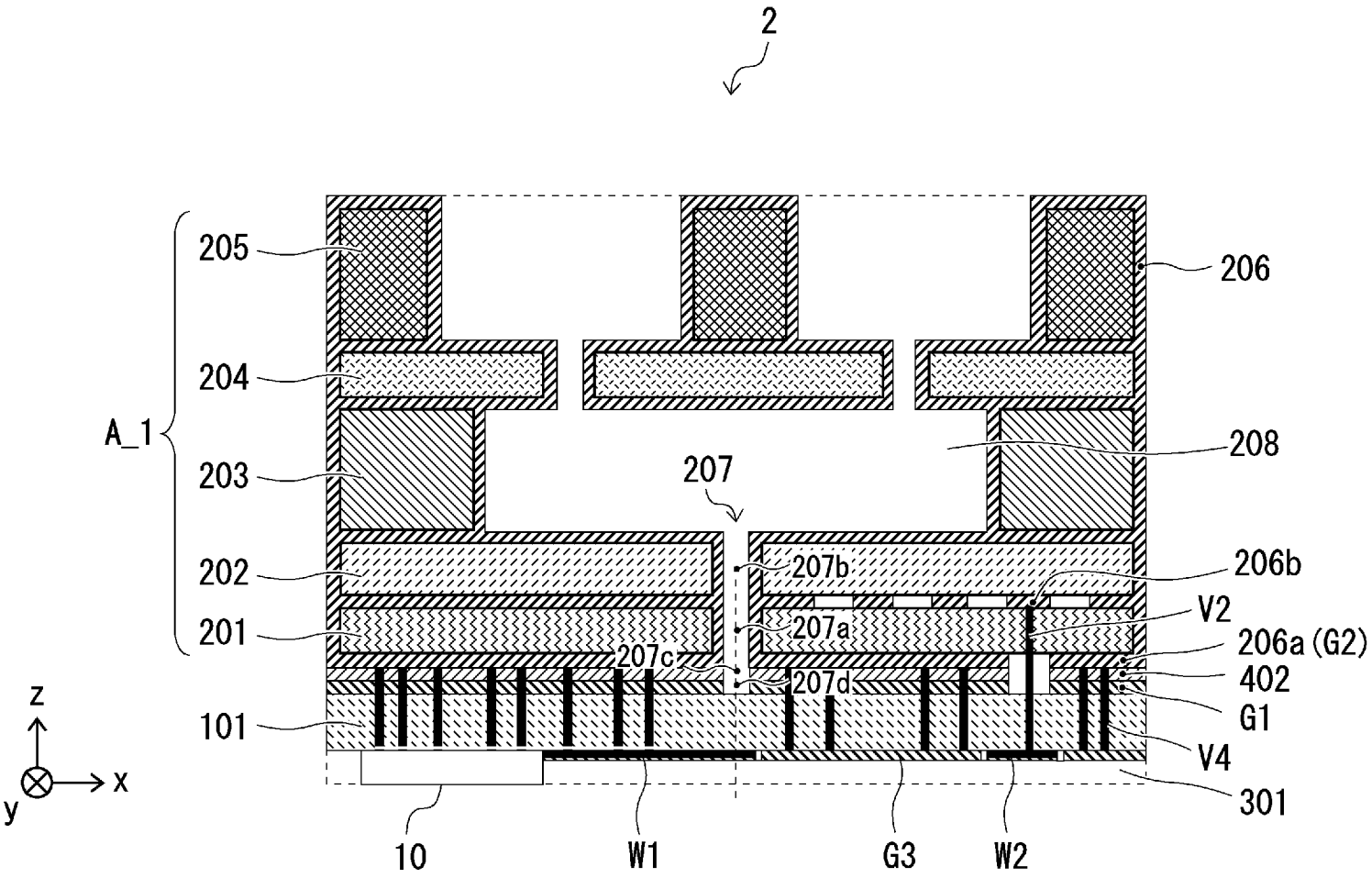
FIG. 6 is a schematic cross-sectional view of a radio communication apparatus according to a second example embodiment.
Figure 7:
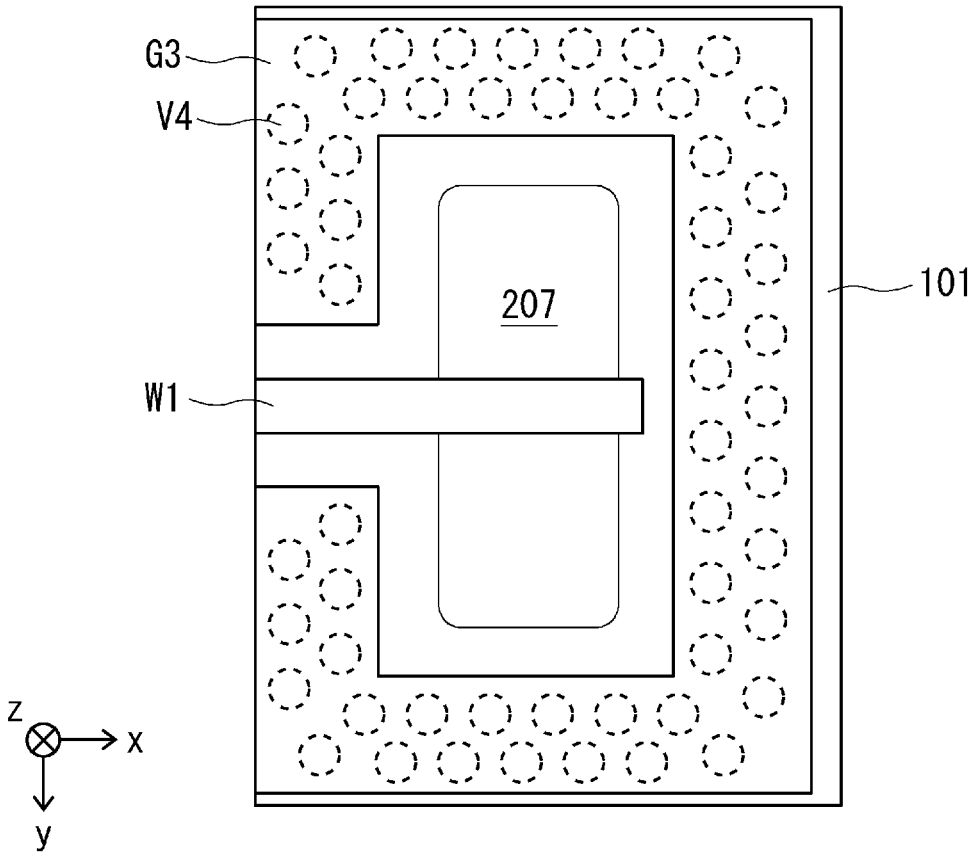
FIG. 7 is a schematic plan view showing a part of the radio communication apparatus shown in FIG. 6.

FIG. 6 is a schematic cross-sectional view of a radio communication apparatus 2 according to a second example embodiment. FIG. 7 is a schematic plan view of the radio communication apparatus 2 of FIG. 6 viewed in the z-axis direction. In the radio communication apparatus 2, compared with the radio communication apparatus 1, the connection layer 401 is formed using a nonconductive connection member 402 and a plurality of vias V4, instead of a conductive bonding film, The nonconductive connection member 402 is prepreg, for example, and bonds together the ground layer G1 of the RF circuit 10 and the ground layer G2 of the antenna element A_1. The connection member 402 has the through hole 207*c*, as in the case of the conductive connection layer 401.

The plurality of vias V4 are formed from the ground layer G1 of the RF circuit 10 to reach the ground layer G2 of the antenna element A_1, penetrating the connection member 402. Thus, the ground layer G1 of the RF circuit 10 and the ground layer G2 of the antenna element A_1 are electrically connected through the plurality of vias V4. As shown in FIG. 7, the plurality of vias V4 are provided surrounding the through hole 207. Leakage of radio waves from the through hole 207 to the outside through the connection member 402 is thereby prevented.

In the example of FIG. 6, the printed board 101, the connection member 402, and the antenna element A_1 are layered first in terms of a manufacturing process. After that, the plurality of vias V4 are formed to penetrate the printed board 101, the ground layer G1, and the connection member 402 from a ground layer G3 formed on the main surface of the printed board 101 on the side of the RF circuit formation layer 301 to reach the ground layer G2 of the antenna element A_1.

The radio communication apparatus 2 according to this example embodiment brings about the same effects as the case of the radio communication apparatus 1.

[Modified Example of Radio Communication Apparatus 2]

Figure 8:
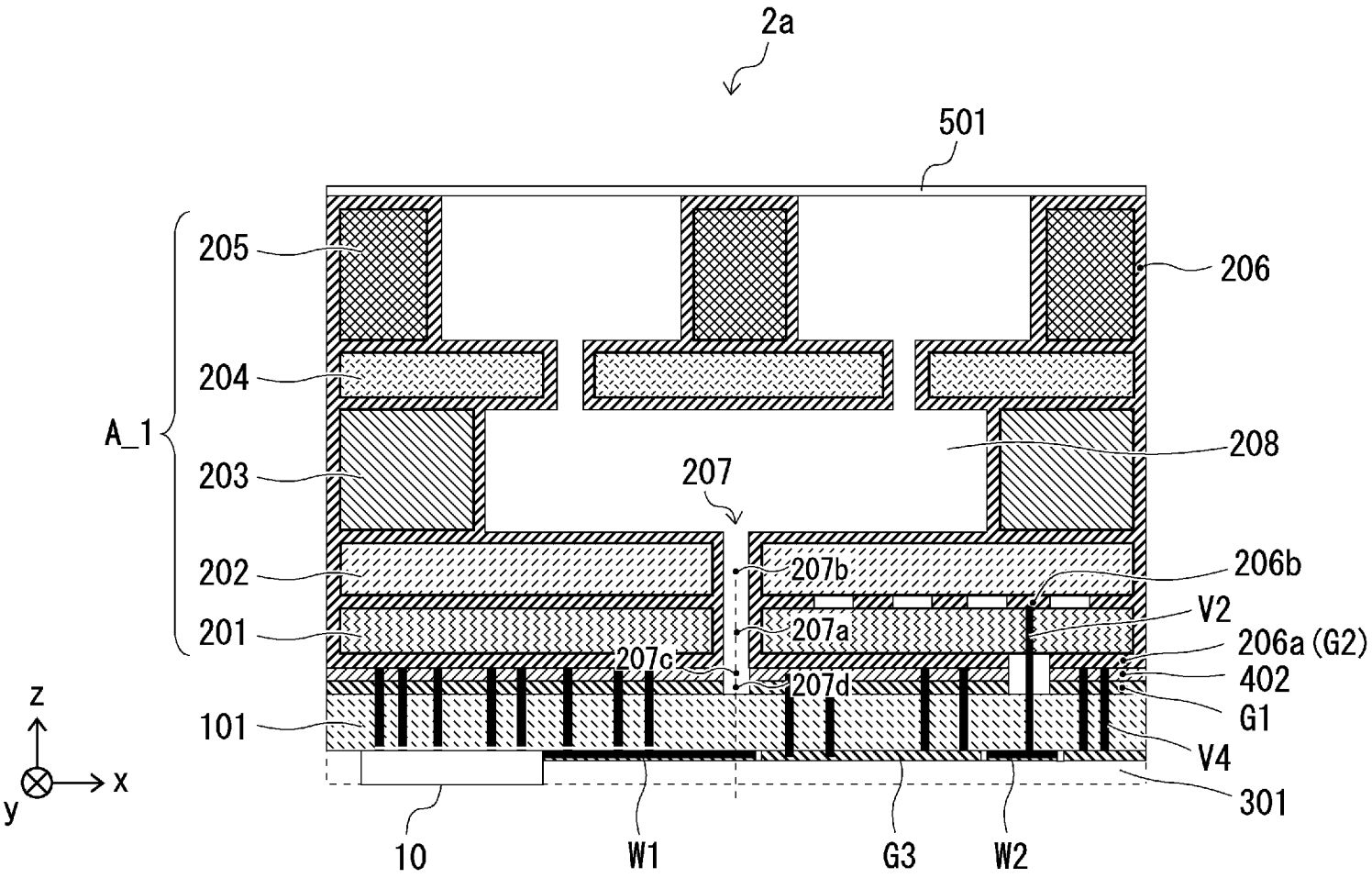
FIG. 8 is a schematic cross-sectional view showing a modified example of the radio communication apparatus according to the second example embodiment.

FIG. 8 is a schematic cross-sectional view showing a modified example of the radio communication apparatus 2 as a radio communication apparatus 2*a*.

In the radio communication apparatus 2*a*, compared with the radio communication apparatus 2, a protective layer 501 is further provided.

The protective layer 501 is provided on top of the antenna element A_1 so as to cover the through hole 207 and the space area 208. This prevents the entry of water and dust and the occurrence of corrosion in the through hole 207 and the space area 208.

The protective layer 501 is preferably configured to have a thickness represented by $0.5(1+M)\lambda e$, where M is an arbitrary integer of 0 or more, and $\lambda e$ is the wavelength of an RF signal propagating through the protective layer 501. This suppresses the interference of transmission (or reception) of the RF signal R1_1 by the protective layer 501. Alternatively, the protective layer 501 may be configured to be so thin that the influence of the interference on transmission (or reception) of the RF signal is negligible.

Note that a protective layer formed on top of the antenna element A_1 in order to prevent entry of unnecessary coating in a plating step, which is one step of a manufacturing process, for example, may be used as the protective layer 501.

Although the case where the protective layer 501 is applied to the radio communication apparatus 2 is described in this example embodiment, the present disclosure is not limited to this case, and the protective layer 501 may be applied to the radio communication apparatus 1, 1*a* or the like.

As described above, in the radio communication apparatus according to the first and second example embodiments, the transmission line W2 other than the transmission line W1 for transmitting RF signals is formed between the plurality of dielectric substrates, which are components of the antenna, using the metal film provided between the plurality of dielectric substrates. By doing so, in the radio communication apparatus according to the first and second example embodiments, it is not necessary to increase the number of layers of the RF circuit formation layer, so that the transmission line W1 for transmitting the RF signal can be wired without using a via. As a result, the power loss of the RF signals is suppressed.

Further, in the radio communication apparatus according to the first and second example embodiments, by using an antenna made up of a plurality of layered dielectric substrates, it is capable of transmitting (or receiving) an RF signal with a wider bandwidth compared with the case of using the patch antenna. Therefore, the radio communication apparatus according to the first and second example embodiments is capable of transmitting (or receiving) wideband RF signals with reduced power loss.

In the first and second example embodiments, the case where a part of the transmission line W2 is formed using the metal film 206*a* between the dielectric substrates 201 and 202 has been described as an example; however, the present disclosure is not limited to this case. A part of the transmission line W2 may be formed using an arbitrary metal film 206*a* between the dielectric substrates 201 to 205.

In the first and second example embodiments, the case where the metal film 206 is formed on each surface of the dielectric substrate 201 to 205 before the dielectric substrate 201 to 205 are layered has been described as an example, but the present disclosure is not limited to this case. The metal film 206 may be formed only on an exposed surface of the dielectric substrates 201 to 205 after the dielectric substrates 201 to 205 are layered. In this case, the metal film 206*b* is formed by performing a plating treatment only between the dielectric substrates for wiring the transmission line W2 among the plurality of dielectric substrates while the dielectric substrate is masked by the mask pattern of the transmission line W2.

In the first and second example embodiments, the case where the plurality of antenna elements A_1 to A_n are provided on the printed board 101 has been described as an example, but the present disclosure is not limited to this case. The case where one antenna element A_1 is provided on the printed board 101 is included in the scope of the present disclosure as a matter of course.

In the first and second example embodiments, the case where the RF signals S1_1 to S1_*n* are transmitted from the plurality of antenna elements A_1 to A_n has been described as an example, but the present disclosure is not limited to this case. The case where the RF signals S1_1 to S1_*n* are received by the plurality of antenna elements A_1 to A_n, respectively, is also included in the scope of the present disclosure as a matter of course.

Although the present disclosure has been described with reference to the example embodiments, the present disclosure is not limited by the above. The configuration and details of the present disclosure may be modified in various ways as will be understood by those skilled in the art within the scope of the disclosure.

This application is based upon and claims the benefit of priority from Japanese patent application No. 2018-243364, filed on Dec. 26, 2018, the disclosure of which is incorporated herein in its entirety by reference.

REFERENCE SIGNS LIST

1, 2 RADIO COMMUNICATION APPARATUS
1*a*, 2*a* RADIO COMMUNICATION APPARATUS
10 RF CIRCUIT
11 RF SIGNAL GENERATION CIRCUIT
12_1 to 12_*n* PHASE SHIFTER
13 CONTROL CIRCUIT
101 PRINTED BOARD
201 to 205 DIELECTRIC SUBSTRATE
203*a* DIELECTRIC SUBSTRATE
204*a* DIELECTRIC SUBSTRATE
206 METAL FILM
206*a* METAL FILM
206*b* METAL FILM
207 THROUGH HOLE
207*a*, 207*b*, 207*c*, 207*d* THROUGH HOLE (SLIT PATTERN)
208 SPACE AREA
208*a*, 208*b*, 208*c* SLIT PATTERN
301 RF CIRCUIT FORMATION LAYER
302 RF CIRCUIT FORMATION LAYER
303 RF CIRCUIT FORMATION LAYER
401 CONNECTION LAYER
402 CONNECTION MEMBER
501 PROTECTIVE LAYER
A_1 to A_n ANTENNA
G1 to G3 GROUND LAYER
W1 TRANSMISSION LINE
W2 TRANSMISSION LINE
V1 VIA
V2 VIA
V4 VIA

What is claimed is:

1. A radio communication apparatus comprising:

a printed board;

an RF circuit formed on one surface of the printed board and configured to generate an RF signal;

a first transmission line configured to transmit the RF signal;

a second transmission line configured to transmit a different signal from the RF signal;

a first ground layer formed on another surface of the printed board;

an antenna configured to emit the RF signal supplied from the RF circuit through the first transmission line; and a connection layer configured to bond together the antenna and the first ground layer, wherein the antenna comprises:

a plurality of layered dielectric substrates;

a metal film formed on surfaces of the plurality of dielectric substrates; and a through hole formed to penetrate at least a dielectric substrate closest to the printed board among the plurality of dielectric substrates, the first ground layer, and the connection layer, the first transmission line is disposed from the RF circuit to an area facing the through hole on the one surface of the printed board, and a part of the second transmission line is disposed between any of the plurality of layered dielectric substrates.

2. The radio communication apparatus according to claim 1, wherein the part of the second transmission line is formed using a part of the metal film formed between the plurality of layered dielectric substrates.

3. The radio communication apparatus according to claim 1, wherein the connection layer is a conductive bonding film.

4. The radio communication apparatus according to claim 1, wherein the connection layer comprises:

a nonconductive connection member; and a plurality of vias formed to penetrate the nonconductive connection member from the first ground layer to reach a part of the metal film which is in contact with the connection layer.

5. The radio communication apparatus according to claim 4, wherein the plurality of vias are provided to surround the through hole.

6. The radio communication apparatus according to claim 4, wherein the nonconductive connection member is prepreg.

7. The radio communication apparatus according to claim 1, further comprising:

a protective layer provided on top of the antenna so as to cover the through hole.

8. The radio communication apparatus according to claim 7, wherein the protective layer is configured to have a thickness represented by $0.5(1+M)\lambda e$, where M is an arbitrary integer of 0 or more, and Ae is a wavelength of the RF signal propagating through the protective layer.

9. The radio communication apparatus according to claim 1, wherein the plurality of dielectric substrates are made of the same material as that of the printed board, or a glass substrate.

10. The radio communication apparatus according to claim 1, wherein the antenna further comprises a metallic material layered with the plurality of dielectric substrates.

11. The radio communication apparatus according to claim 1, wherein the different signal is any of a signal before being modulated into the RF signal, a local signal used for modulating the RF signal, and a power supply voltage.

12. The radio communication apparatus according to claim 1, wherein the RF signal is a millimeter wave in a band of 26 GHz to 110 GHz.

13. The radio communication apparatus according to claim 1, wherein the RF signal is a millimeter wave in a band of 60 GHz to 90 GHz.

14. A radio communication apparatus comprising:

a printed board;

an RF circuit formed on one surface of the printed board and configured to generate a plurality of RF signals;

a plurality of first transmission lines configured to transmit the plurality of RF signals;

a plurality of second transmission lines configured to transmit a plurality of signals different from the plurality of RF signals;

a first ground layer formed on another surface of the printed board;

a plurality of antenna elements configured to emit the plurality of RF signals supplied from the RF circuit through the plurality of first transmission lines, respectively; and a connection layer configured to bond together the plurality of antenna elements and the first ground layer, wherein each of the plurality of antenna elements comprises:

a plurality of layered dielectric substrates;

a metal film formed on surfaces of the plurality of dielectric substrates; and a through hole formed to penetrate at least a dielectric substrate closest to the printed board among the plurality of dielectric substrates, the first ground layer, and the connection layer, each of the plurality of first transmission lines is disposed from the RF circuit to an area facing the through hole on the one surface of the printed board, and a part of each of the plurality of second transmission lines is disposed between any of the plurality of layered dielectric substrates.

15. The radio communication apparatus according to claim 14, wherein the part of each of the plurality of second transmission lines is formed using a part of the metal film formed between the plurality of layered dielectric substrates.

16. The radio communication apparatus according to claim 14, wherein the connection layer is a conductive bonding film.

17. The radio communication apparatus according to claim 14, wherein the connection layer comprises:

a nonconductive connection member; and a plurality of vias formed to penetrate the nonconductive connection member from the first ground layer to reach a part of the metal film which is in contact with the connection layer in each of the plurality of antenna elements.

18. The radio communication apparatus according to claim 17, wherein the plurality of vias are provided to surround the through hole in each of the plurality of antenna elements.

19. The radio communication apparatus according to claim 17, wherein the nonconductive connection member is prepreg.

20. The radio communication apparatus according to claim 14, further comprising:

a protective layer provided on top of the plurality of antenna elements so as to cover the through hole in each of the plurality of antenna elements.

* * * * *